US005293693A

United States Patent [19]

Nelson et al.

[11] Patent Number: 5,293,693

[45] Date of Patent: Mar. 15, 1994

[54] VACUUM VALVE DESIGN FOR DIE CASTING

[75] Inventors: Craig A. Nelson, Windom, Minn.; Russell J. VanRens, Milwaukee, Wis.

[73] Assignee: Outboard Marine Corporation, Waukegan, Ill.

[21] Appl. No.: 874,368

[22] Filed: Apr. 27, 1992

[51] Int. Cl.[5] ..... G01B 5/26; B22D 17/20

[52] U.S. Cl. ..... 33/1 R; 33/121

[58] Field of Search ..... 33/1 R, 121

[56] References Cited

U.S. PATENT DOCUMENTS 2,562,749 7/1951 Speer ..... 33/121
2,747,795 5/1956 Kreuttner ..... 33/121
2,971,230 2/1961 Coleman et al. .
4,326,338 4/1982 Plante ..... 33/121
4,538,666 9/1985 Takeshima et al. .
4,577,670 3/1986 Moore .
4,852,634 8/1989 Kawai et al. .

*Primary Examiner*—William A. Cuchlinski, Jr.
*Assistant Examiner*—C. W. Fulton
*Attorney, Agent, or Firm*—Welsh & Katz, Ltd.

[57] ABSTRACT

A method for determining the size of the open area of a vacuum valve for use in a die casting operation is disclosed. The invention determines the size primarily as a function of the total length of the exterior parting lines of the die. Apparatus for producing die castings is disclosed which has a vacuum valve with a specified open flow area.

10 Claims, 1 Drawing Sheet

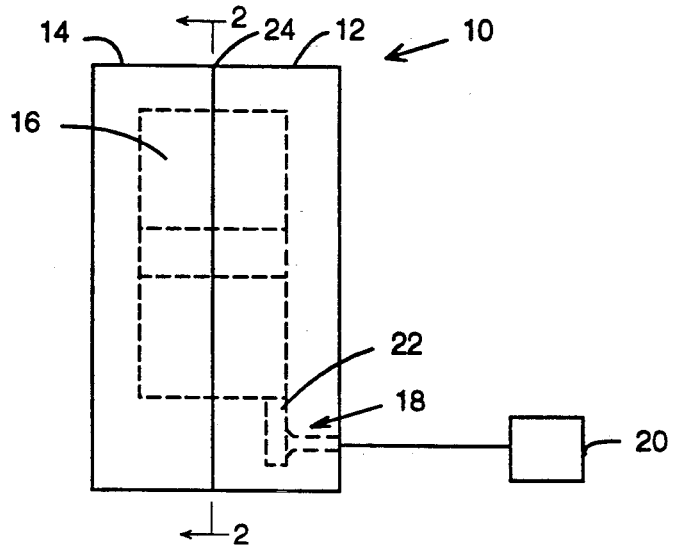
Fig. 1
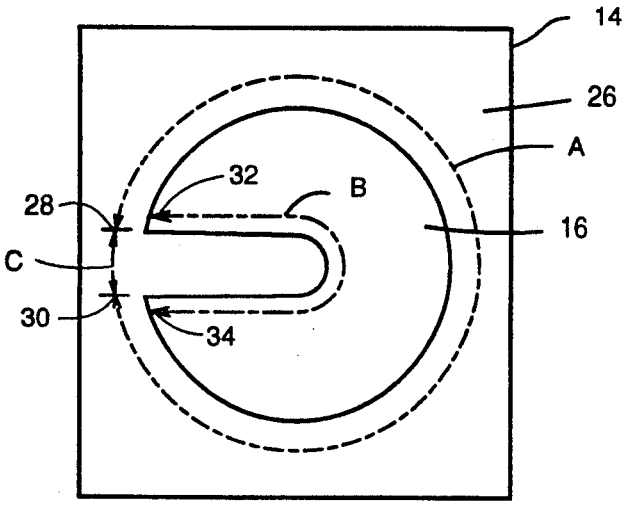
Fig. 2
Fig. 3
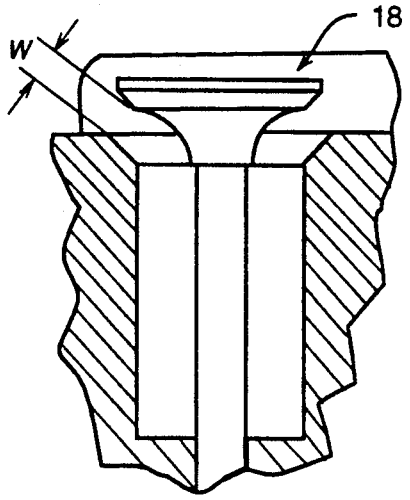
Fig. 4
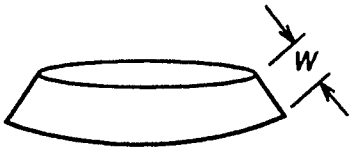

VACUUM VALVE DESIGN FOR DIE CASTING

CROSS REFERENCE TO RELATED APPLICATIONS

Title: SEALED SHOT SLEEVE FOR VACUUM DIE CASTING
Inventors: Schultz Smith, Van Rens
Ser. No.: 874,740

Title: DOUBLE SOLENOID VALVE ACTUATOR
Inventor: Van Rens
Ser. No.: 874,755

Title: VACUUM VALVE FOR DIE CASTING
Inventors: Van Rens, Rumford, Schultz
Ser. No.: 874,629

Title: VACUUM DIE CASTING PROCESS
Inventors: Campbell et a
Ser. No.: 874,648

The present invention generally relates to die casting methods and apparatus, and more particularly to a method for determining the optimum size of vacuum valves used in a vacuum valve die casting operation.

It is generally known that evacuation of air from the die cavity where castings are formed in a metal die casting operation produces improved quality castings, particularly with respect to their surface porosity. While there have been different designs for providing a vacuum to the die cavity, most of the designs have a valve which communicates the die cavity with a source of vacuum and this valve is opened to evacuate the cavity immediately prior to placing a shot of molten metal into the cavity and is then closed before the metal reaches the cavity. If the valve is not closed before the metal reaches the cavity, there is a distinct possibility that the metal may enter the valve and prevent it from closing completely. If such fouling of the valve occurs, disassembly of the valve mechanism to clear the debris from it must be done before further casting operations can be carried out.

One design has the valve being closed by the force of the casting metal itself as the metal is being shot or injected into the die cavity. As might be expected, such an arrangement is prone to fouling and has been proven to be unreliable.

Another important consideration in a vacuum die casting operation is that the vacuum level be sufficiently high so that very little air remains in the die cavity and that the vacuum be maintained at a desired level while the metal is being injected into the cavity. If the valve communicating the vacuum with the cavity closes too early, air inevitably leaks back into the cavity and may impair the desirable advantages of the vacuum and create surface anomalies in the casting. Since the casting must be removed from the die cavity after the casting process, the die body generally has at least two separable components, and may have more than two, particularly if a complex casting is being made.

In the die casting art, the interface between die components define what are known as parting lines, some of which may be interior and others which are exposed to the exterior of the die body. For purposes of the present invention, the phrase "exterior parting lines" are defined as those parting lines adjacent the die cavity itself which when a line is considered to extend generally from the center of the cavity crosses the die cavity boundary, that parting line is in communication with the exterior of the die. The exterior parting lines, even if the die components are held to close tolerances, represent a leakage path through which air can travel to the die cavity. Since it is highly desirable to have a vacuum in the die cavity that is at least 23 inches of mercury, and preferably 28½ to 29 inches of mercury, such high vacuum levels cannot be effectively maintained if the cross-sectional area of the valve itself is not sufficiently large to effectively evacuate air, or if the gate area between the valve and the die cavity itself is not sufficiently and comparably sized.

While many vacuum valves may be effective for relatively small castings, the effective opening of the valve may be too small when large castings are made. The opening must be sufficiently large to initially evacuate air from the die cavity and also maintain the vacuum within the cavity. The amount of leakage air that is reintroduced into the cavity is largely a function of the total length of parting lines adjacent to the die cavity that are in communication with the atmosphere, i.e., the parting lines that are exposed to external surfaces of the die.

Accordingly, it is a primary object of the present invention to provide an improved method of determining the size of the open area of a vacuum valve to insure that proper vacuum levels are attained during a vacuum die casting operation.

Another object of the present invention is to provide such an improved method of the foregoing type, which takes into account the size of the casting that is being made.

Still another object of the present invention is to provide an improved method of determining the size of the opening of the vacuum valve as a function of the exterior parting lines of the casting that is to be made.

Other objects and advantages will become apparent from the following detailed description, while referring to the attached drawings, in which:

FIG. 1 is a top view of a die shown together with a vacuum valve, which represents the environment of the present invention;

FIG. 2 is a view taken generally along the line 2—2 of FIG. 1;

FIG. 3 is a side elevation of a preferred vacuum valve that may be used in a die casting operation; and, FIG. 4 is a perspective of the shape of the effective opening of the vacuum valve.

DETAILED DESCRIPTION

Broadly stated, the present invention is directed to a method for determining the size of the open area of a valve that is adapted to communicate a source of vacuum with a die cavity in a die casting apparatus.

Turning now to the drawings, and particularly FIG. 1, a die, indicated generally at 10, is illustrated and includes a right portion 12 and a left portion 14 as shown in FIG. 1, with an internal cavity 16 being defined by the components 12 and 14. The apparatus shown in FIG. 1 is a top view and has a vacuum valve, indicated generally at 18, located at the lower portion of the drawing, which is preferably on the top of the die itself. The valve 18, which preferably has a construction as shown in FIG. 3, and which is shown and described in the above cross-referenced application, Ser. No. 874,629 which is incorporated by reference herein, communicates a source of vacuum, schematically illustrated at 20, and the die has a gate area 22 that extends to the cavity 16 so that when the valve 18 is open, the vacuum evacuates the cavity 16 prior to a die casting material being injected into the cavity for the purpose of forming a casting.

The interface between the die components 12 and 14 is marked at 24 and the face of the component 14 is identified at 26. The cavity 16 is shown to have a generally circular configuration with a horizontal portion that extends from the side to the general center thereof. The portion of the cavity formed in the component 12 is similarly configured. It should be understood that the entire interface 24 defines the parting line of the die, and with respect to the cavity 16, the parting line has a segment marked "A" extending from point 28 to point 30 which is an exterior parting line, as well as the segment marked "B" from point 32 to point 34 which is on the interior segment. However, the leakage would also be able to occur from the segment marked "C" which extends from point 28 to point 30.

In the illustration of FIG. 2, the segment A is certainly an exterior parting line as is a portion of the segment B that has communication with the exterior and is represented by the segment C, since it can communicate the die cavity 16 to atmosphere. However, the majority of segment B is basically interior and no leakage would occur that would not otherwise occur through the segments A and C. For this reason, the leakage path is defined by segments A and C and not segment B. The length of the parting lines is measured adjacent the die cavity, rather than around the external surfaces of the die components 12 and 14.

It should be understood that each casting that is made would have different length of exterior parting lines, depending upon the shape of the casting and the size of it. For each casting that is made, the length of external parting lines should be determined for the purpose of determining the size of the open area of the valve that communicates the vacuum to the die cavity. It should also be understood that the effective open area of the valve 18 will be determined in accordance with the present invention and that once the valve dimensions are determined, it should also be understood that the cross-sectional area of the gate 22 which communicates the valve with the cavity itself, should be no less than the cross-sectional area of the valve, or it will detrimentally affect the evacuation of the cavity. Stated in other words, it serves little useful purpose to size the open area of the valve at a desired value and then provide a bottleneck between the valve and the cavity itself. The valve 18 moves between its open and closed positions, and when in the open position, the effective open area of the valve 18 is generally represented by the area of a frustrum of a cone as generally shown in FIG. 4. The area can be calculated by multiplying the average circumference of the cone by the distance W between the valve surface and the seat. The stroke of the valve is generally within the range of approximately ⅛ inches to approximately ¼ inches.

In accordance with an important aspect of the present invention, the size of the open area of the vacuum valve has been found to provide uniformly good evacuation of air when the open area of the valve in square inches is less than 0.008 inches times the length of the external parting line, in inches, but greater than or equal to the product of 0.003 inches times the length of the external parting line, in inches. In metric values, the open area in square millimeters should be less than or equal to the product of 0.20 millimeters times the length of external parting line in millimeters, but greater than or equal to the product of 0.075 millimeters times the length of external parting line in millimeters. The parting line length is measured adjacent the cavity itself, rather than the external dimensions of the die itself.

If the area of the valve is not greater than the product of 0.003 inches and the external parting line length in inches, then an insufficient vacuum will be established in the die cavity. Since it is desirable that 95% of the air be removed from the cavity, by having the valve area exceed this criteria, then the desired level of evacuation will be provided. Given the fact that 29.5 inches of mercury is approximately equal to zero air present, by having the area greater than or equal to this product, then 25 to 26 inches of mercury will be achieved.

Another consideration is that the area of the valve be less than or equal to the product of 0.008 inch times the external parting line length in inches. This is a practical limitation in that the valve must travel through its stroke between being completely open and closed. If the stroke of the valve is too large, then it will take a longer time to close it, and given the extremely fast tines in which the metal is injected into the cavity, it is necessary for reliable operation that the valve be closed in approximately 15 milliseconds. This provides some time to enable reliable closing of the valve and still have the cavity filled in approximately 30 milliseconds.

From the foregoing, it should be understood that a method of determining the size of the open area of a valve used in vacuum die casting has been shown and described which results in reliable, effective evacuation of the cavity to vacuum levels that result in superior castings that exhibit very few surface imperfections. When a casting operation is being set up, the size of the valve can be determined to provide optimum evacuation of air from the die cavity, and yet not be so large that the valve cannot be closed in the appropriate time.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. A method of determining the size of open area of a valve means adapted to communicate a die cavity with a source of vacuum to enable the rapid evacuation of air from the die cavity immediately prior to placing a shot of molten metal into the die cavity, the valve means being used in a die casting apparatus of the type wherein the die comprises at least two components that are positioned together during a die casting operation and are separable to remove the die casting, the components defining parting lines along the interface of the components in the die cavity, the method comprising:

determining the total length of parting lines adjacent to the die cavity that are exposed to the exterior of the die;

determining the size of the open area in square inches of the valve means to be equal to or greater than 0.003 inches multiplied by the determined total length in inches of parting lines.

2. A method as defined in claim 1 wherein the size of the open area in square inches is further defined to be equal to or less than 0.008 inches multiplied by the determined total length in inches of parting lines.

3. A method as defined in claim 1 wherein said valve means comprises at least one valve.

4. A method as defined in claim 1 wherein said open area of a valve means comprises the effective area of each individual valve that communicates a die cavity with a source of vacuum when each valve is in its open position.

5. A method of determining the size of open area of a valve means adapted to communicate a die cavity with a source of vacuum to enable the rapid evacuation of air from the die cavity immediately prior to placing a shot of molten metal into the die cavity, the valve means being used in a die casting apparatus of the type wherein the die comprises at least two components that are positioned together during a die casting operation and are separable to remove the die casting, the components defining parting lines along the interface of the components in the die cavity, the method comprising:

determining the total length of parting lines adjacent to the die cavity that are exposed to the exterior of the die;

determining the size of the open area in square inches of the valve means to be equal to or greater than 0.003 inches multiplied by the determined total length in inches of parting lines, and equal to or less than 0.008 inches multiplied by the determined total length in inches of parting lines.

6. A method of determining the size of open area of a valve means adapted to communicate a die cavity with a source of vacuum to enable the rapid evacuation of air from the die cavity immediately prior to placing a shot of molten metal into the die cavity, the valve means being used in a die casting apparatus of the type wherein the die comprises at least two components that are positioned together during a die casting operation and are separable to remove the die casting, the components defining parting lines along the interface of the components in the die cavity, the method comprising:

determining the total length of parting lines adjacent to the die cavity that are exposed to the exterior of the die;

determining the size of the open area in square millimeters of the valve means to be equal to or greater than 0.075 millimeters multiplied by the determined total length in millimeters of parting lines.

7. A method as defined in claim 6 wherein the size of the open area in square millimeters is further defined to be equal to or less than 0.2 millimeters multiplied by the determined total length in millimeters of external parting lines.

8. A method as defined in claim 6 wherein said valve means comprises at least one valve.

9. A method as defined in claim 6 wherein said open area of a valve means comprises the effective area of each individual valve that communicates a die cavity with a source of vacuum when each valve is in its open position.

10. A method of determining the size of open area of a valve means adapted to communicate a die cavity with a source of vacuum to enable the rapid evacuation of air from the die cavity immediately prior to placing a shot of molten metal into the die cavity, the valve means being used in a die casting apparatus of the type wherein the die comprises at least two components that are positioned together during a die casting operation and are separable to remove the die casting, the components defining parting lines along the interface of the components in the die cavity, the method comprising:

determining the total length of parting lines adjacent to the die cavity that are exposed to the exterior of the die;

determining the size of the open area in square millimeters of the valve means to be equal to or greater than 0.075 millimeters multiplied by the determined total length in millimeters of parting lines, the equal to or less than 0.2 millimeters multiplied by the determined total length in millimeters of parting lines.

* * * * *